US005253635A

United States Patent [19]

Overall et al.

[11] Patent Number: 5,253,635

[45] Date of Patent: Oct. 19, 1993

[54] GAS-FIRED HEATER

[75] Inventors: John C. K. Overall, Scarborough, Canada; Hayk A. Tikiryan, Thornhill, Canada

[73] Assignee: Canadian Gas Research Institute, Ontario, Canada

[21] Appl. No.: 875,474

[22] Filed: Apr. 29, 1992

[51] Int. Cl.[5] ..... F24C 3/00

[52] U.S. Cl. ..... 126/85 B; 126/72; 126/91 R; 237/2 R

[58] Field of Search ..... 126/85 B, 72, 90 R, 126/91 R, 91 A; 431/19, 45; 237/2 R, 11, 2 A, 50

[56] References Cited

U.S. PATENT DOCUMENTS

| | | | |
|---|---|---|---|
| 2,682,867 | 7/1954 | Cartter | 126/91 A X |
| 3,234,930 | 2/1966 | Hodges | 126/90 R |
| 3,674,005 | 7/1972 | Barnett et al. | 126/91 A |
| 4,187,835 | 2/1980 | Finney | 126/91 A X |
| 4,869,229 | 9/1989 | Johnson | 126/91 A |
| 4,869,230 | 9/1989 | Fletcher et al. | 126/91 A |
| 4,929,173 | 5/1990 | Jacobs et al. | 126/91 A X |

OTHER PUBLICATIONS

One page brochure undated, producted by Canadian Gas Research Institute.

Press Release dated Aug. 26, 1988, written by Ed Cartwright of Canadian Gas Research Institute; subsequently published: Southam Bldg. Guide, Oct. '88 Issue, entitled "Gas-fired baseboard heaters developed".

Blown-up version of an article which appeared in the publication Home Builder—Nov./Dec. '88,—47 issue.

Undated 4 page photocopy of Brochure entitled: "The Baseboard Direct Vent Wall Furnace", by the Empire Stove Co., Belleville, Illinois.

Undated, photocopy of an article which appeared in an unknown publication printed in the U.S.A. Form S-GB, entitled "Baseboard Gas Heaters by Siegler", for the Siegler Heater Division, Centralia, Illinois.

Undated, photocopy of an 8 page instruction manual for Installation Operation Instructions, for a Siegler Model LSB 10-2D Sealed Combustion Gas Baseboard Heater; Lear Siegler (Canada) Ltd., Orilla, Ontario (LSC-22-59-A).

An undated brochure advertising "The Gas Baseboard Heater—Modulating Gas Heating—CGM" by Dettson and available from Gaz Métropolitain, Sherbrooke, Quebec & Mississauga, Ontario.

*Primary Examiner*—Larry Jones

*Attorney, Agent, or Firm*—Bereskin & Parr

[57] ABSTRACT

A sealed combustion, low profile gas-fired baseboard heater has a heat exchanger which is U-shaped, and which has upper and lower horizontal sections. Appropriate inlets are provided for air and combustion gas, and a gas valve. The air inlet may be coaxial with an exhaust for combustion gases. The heater may include a combustion blower, in which case the heat exchanger can include fins and other features to improve heat transfer. A natural draft version includes a larger bore tubular heat exchanger. Ignition can be by way of a pilot. Alternatively, a hot surface igniter, with safety lockout-timing device, can be used.

22 Claims, 4 Drawing Sheets

GAS-FIRED HEATER

FIELD OF THE INVENTION

This invention relates to a gas-fired heater, and more particularly is concerned with a gas-fired baseboard heater having a similar profile to conventional electric baseboard heaters.

BACKGROUND

Electric baseboard heaters are well known. Conventionally, electric baseboard heaters are elongate and have a low profile. Usually, they have an elongate finned heating element and a simple control switch, optionally with a thermostat, at one end. Elongate top and bottom openings are provided in an outer housing, to enable natural convection to transfer the heat to the room air.

With the introduction of flexible gas distribution systems for buildings, opportunities for new applications have developed. One such opportunity involves using a gas-fired baseboard heater in applications where electric baseboard heaters are currently used. The attractiveness of using gas as an original or a replacement source of energy has increased due to the large increases in electricity rates compared to the more steady gas prices.

There are known designs for gas-fired baseboard heaters, but these are large and bulky, often resembling room heaters more than baseboard heaters.

Known gas baseboard heaters currently use a natural draft sealed combustion system with a standing pilot and a conventional gas control valve. Based on conventional gas technology, the flame is oriented vertically and the heat exchanger is relatively bulky. As a result, the whole device is bulky and unattractive and occupies a lot of space. Such existing baseboard heaters use multi-port burners, which again increases the bulk of the device.

Heat is readily transferred from the heat exchanger to the surrounding air by natural convection. Cooler air at the floor level enters via the lower grille and is heated as it rises past the heat exchanger and exits from a top mounted discharge grille. Most heaters of this type are equipped with a local thermostat mounted on the heater itself, to regulate the operation of the heater.

SUMMARY OF THE PRESENT INVENTION

In accordance with the present invention, there is provided a gas-fired heater, for mounting on a wall within a building, the heater comprising: a gas inlet for combustion gas; a combustion air inlet; a burner connected to the combustion and gas inlets; and an elongate U-shaped heat exchanger including a generally horizontal lower section into which the burner discharges combustion gases, and a generally horizontal upper section connected to the lower section and having an outlet for exhaust combustion gases. The gas-fired heating device of the present invention has a low profile and is intended for installation along a section of the wall in a room. For this purpose, it preferably includes a casing having upper and lower grilles for natural convection. One embodiment of the invention uses a natural draft-sealed combustion system with either a standing pilot or an intermittent pilot and a gas control valve. Another embodiment of the invention uses a power-vented sealed combustion system with either hot surface ignition or spark ignition and a gas control valve. The power-vented version preferably includes additional control features such as a pressure switch-based proof of flow, and a safety lockout timing device. A gas control valve and an appropriately sized gas orifice regulate the desired flow of gas. Preferably, it includes a horizontally-directed mono-port burner.

During operation, air is drawn in from the outdoors and into the combustion air chamber where the gas and air are mixed, and are then passed through the mono-port burner and ignited. The resulting products of combustion are passed through the U-shaped heat exchanger and are preferably exhausted to the outside, by a tube concentrically positioned inside the combustion air passage. The tubular heat exchanger advantageously is made up of two major sections; a lower section which is connected to the combustion air chamber and an upper section which is connected to the exhaust tube. The two sections are joined together using elbows or other transition components.

The diameter of the heat exchanger may be the same for both the bottom and top sections, or the bottom section may be of a larger diameter than the top section. Finned tubing is preferably in the power-vented version, for enhancement of heat transfer from the hot combustion gases to the surrounding air. In known manner, the finned tubing aids in heat transfer by effectively increasing the heat transfer surface area.

In the power-vented version, a blower is used to draw combustion air and push it through the U-shaped heat exchanger and out the exhaust tube. A smaller diameter tubing can be used for the heat exchanger than in the natural draft version of this baseboard heater. Additionally, in the power-vented version, heat transfer is enhanced in the upper section by using an in-line turbulator. The turbulator increases turbulence in the heat exchanger by increasing the internal flow velocity, which in turn increases the heat transfer rate to the wall of the heat exchanger and then to the surrounding air. Heat is readily transferred to the surrounding air by natural convection. The cooler air enters the casing via the lower grille and is heated as it rises past the heat exchanger and exists from a top mounted discharge grille.

To distribute the heat more evenly in the lower section, thin a layer of thin insulation material is placed in the mouth of the lower section of the heat exchanger. This permits more heat to be transmitted at the other end of the lower section and reduces the wall temperature at the burner end of the heat exchanger.

For the power-vented version, advantageously a differential pressure switch is used to ensure that an adequate flow of combustion air is present before the ignition controls are made operative. In the event of a blower malfunction, the pressure switch would sense that there is inadequate combustion air and would de-energize the gas supply mechanism. Another safety feature that is advantageously employed in the heater is a lockout timing mechanism. This feature, once again, would de-energize the gas valve, thus stopping the flow of gas to the burner, in the event of the burner flame being extinguished due to a temporary loss of gas supply. To re-activate the ignition control system, a manual reset of the thermostat would be required.

The thermostat for this heater may be located within the casing of the heater or it may be located remotely on a wall in the room. This latter feature permits better climate control of the room being heated.

In the drawings as hereinafter described, an embodiment of the power-vented version of the baseboard heater is described. Also described is an embodiment of a naturally vented version of the baseboard heater. However, various other modifications and alternate construction, including a variation in the length of the heat exchanger can be made without departing from the true scope and intent of the invention.

A typical power-vented baseboard heater can be enclosed in a casing having the dimensions of about 19 cm high, 13 cm deep and 122 cm long ($7\frac{1}{2}\times5\times48$ inches) with a firing rate of about 1.5 kW (5,000 BTU/h).

The firing rate of the baseboard heater is about 0.37 kW (1,250 BTU/h) per linear foot of appliance length. The typical embodiment uses 4 linear feet for a total input of about 1.5 kW (5,000 BTU/h).

DESCRIPTION OF THE DRAWING FIGURES

For a better understanding of the present invention and to show more clearly how it may be carried into effect, reference will now be made by way of example, to the accompanying drawings, in which.

DESCRIPTION OF THE PREFERRED EMBODIMENT

The baseboard heater components are enclosed in a casing 1, which is generally rectangular. While a variety of dimensions can be chosen, the casing 1 has the dimensions $19\times13\times122$ cm ($7\frac{1}{2}\times5\times48$ inches). The casing 1 comprises a separate front panel 2 which can be removed, a lower grille 3 which permits the cooler air at the floor level to enter the casing, and a top mounted discharge grille 4 which allows for the heated air to rise into the heating space.

Figure 1:
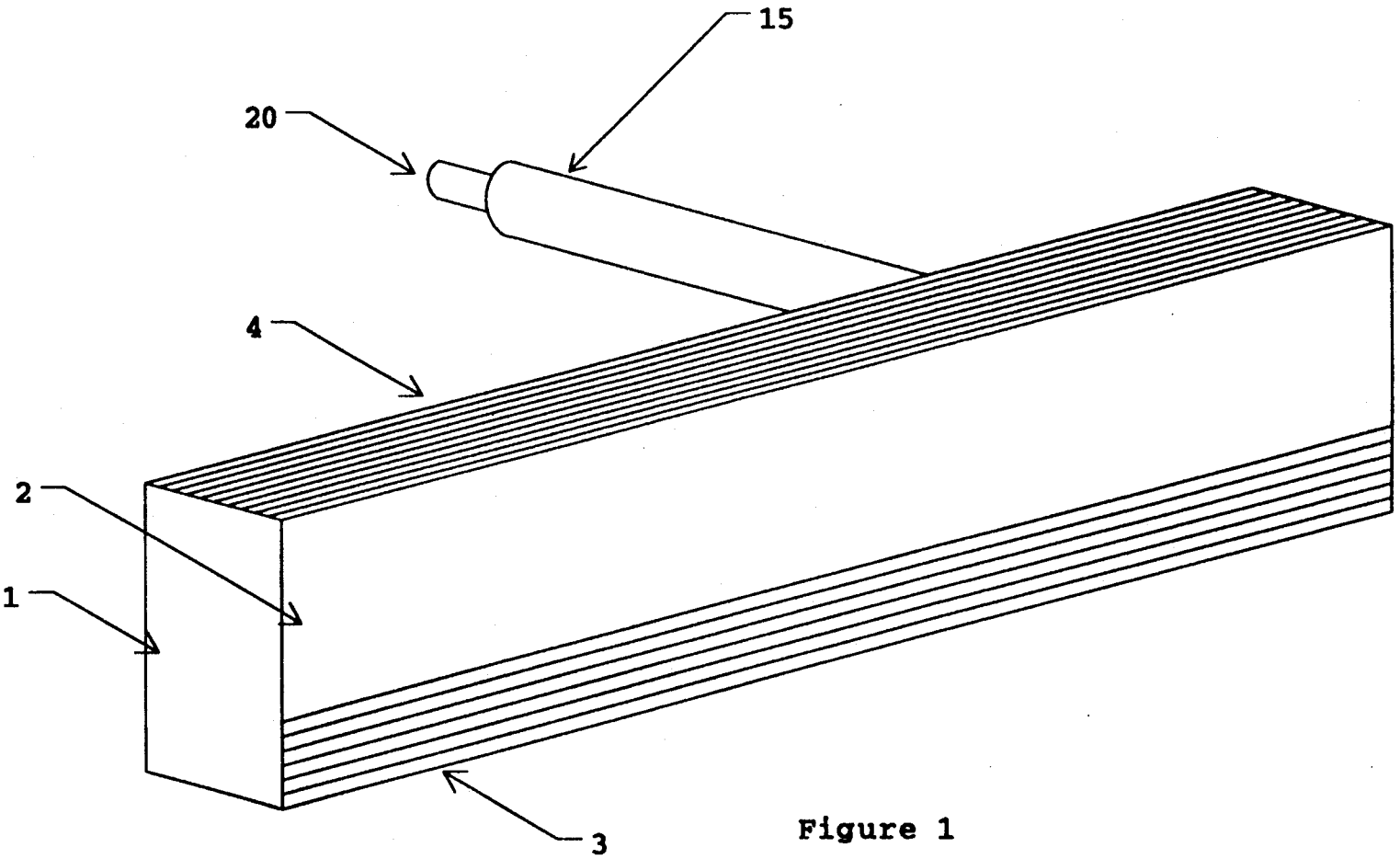
FIG. 1 is a perspective view of a power-vented embodiment of a baseboard heater in accordance with the present invention.
Figure 2:
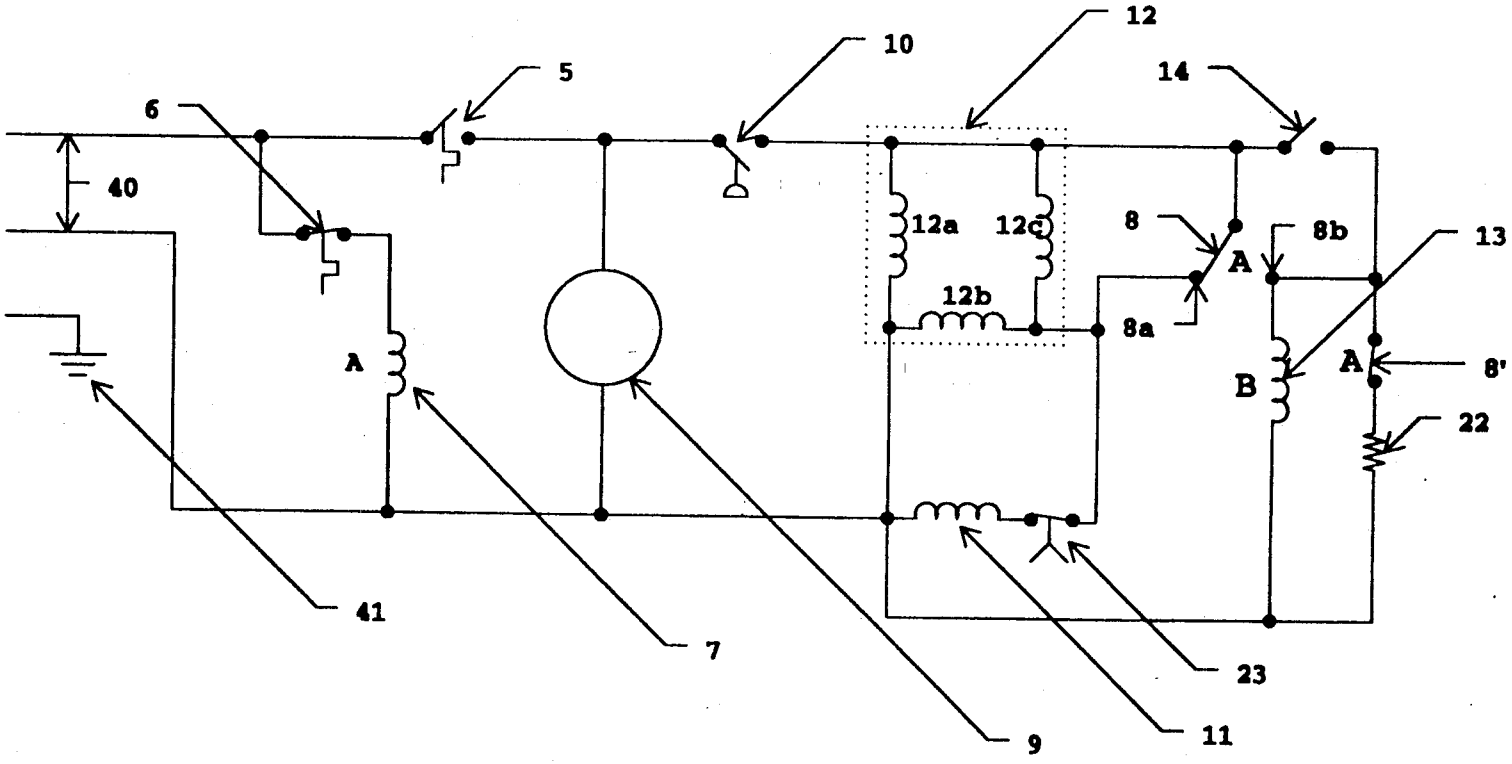
FIG. 2 is a schematic diagram of the control circuit used in the baseboard heater of FIG. 1.

Referring to FIG. 2, the control circuit for the heater has input lines 40 and a ground connection 41, which in known manner would be connected to a conventional domestic 120 volt AC supply. A probe type temperature sensor 6 and coil 7 of a relay A are connected in series between the two lines. A combustion air blower 9 is also connected between the lines. In the top line, a thermostat 5 and a differential pressure switch 10 are connected in series. The switch 10 is in turn connected to a gas valve 12. The valve 12 includes a holding coil **12*a*, a secondary coil 12*b* and a booster coil 12*c*. The valve 12 in turn is connected to contact 8 of the relay A and to contacts 14 of a second relay B having an energizing coil 13. The contact 8 can be switched between contacts 8*a* and 8*b*, while further contacts 8' are either in an open or closed position; with relay A powered, the contact 8 connects to 8*a*, and contacts 8' are closed. Contact 14 is normally open, and is closed when relay B is activated. An igniter 11 is connected in series with a time-delay switch 23 which in turn is connected to the contact 8*a*, as is a connection to the gas valve 12. The switch or contacts 14 and the contact 8*b* are connected to the further pair of contacts 8'. The contact 8*b* and output of contacts 14 are also connected to the coil 13 of relay B, and the output of contacts 8' is connected to a time-delay heater 22. The heater 22 and time-delay switch 23 with related components form a lockout-timing mechanism 21**.

Figure 3:
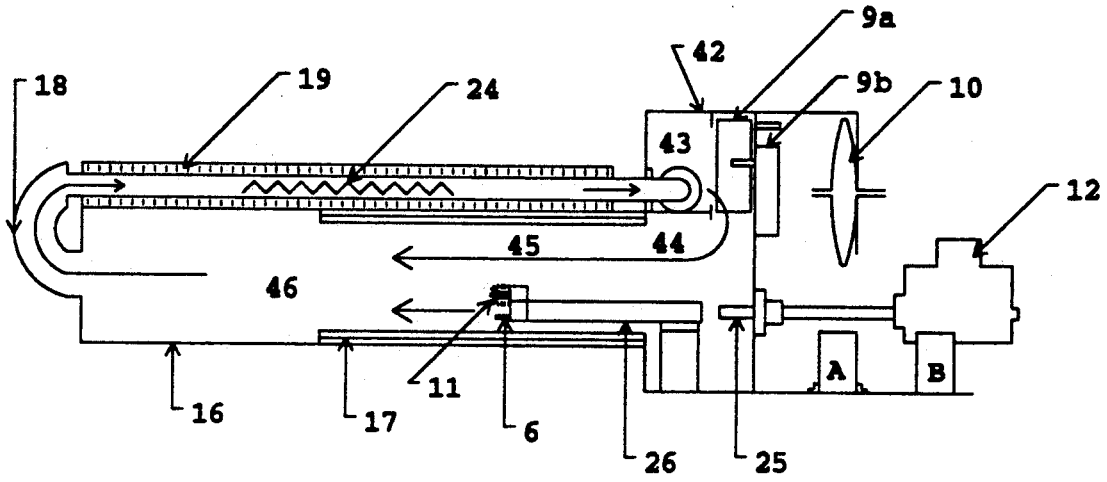
FIG. 3 is a vertical section through the internal components of the baseboard heater of FIG. 1, with a casing removed.
Figure 4:
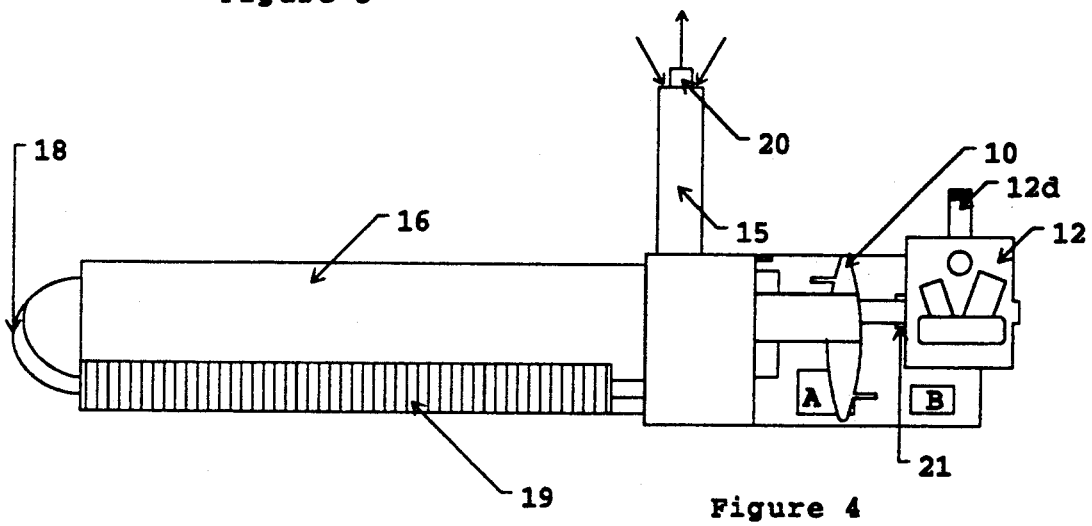
FIG. 4 is a plan view of the baseboard heater components of FIG. 3.
Figure 5:
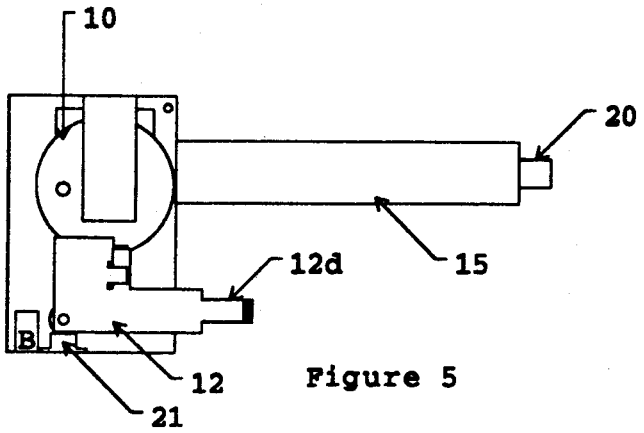
FIG. 5 is an end view of the baseboard heater components shown in FIGS. 3 and 4.

Turning to FIGS. 3, 4 and 5, and details of the mechanical components, at the right hand end of the unit, there is a housing 42 including an inlet chamber 43. An inlet pipe 15 opens into this, as best shown in FIG. 4. FIG. 4 also shows schematically the lockout-timing mechanism 21. The fan or blower 9 includes the actual fan element at **9*a* and a fan motor 9*b*. As shown by the arrow 44, the fan or blower 9 draws combustion air through the inlet 15 and forces it into a combustion chamber 45. A differential pressure switch is mounted at 10, and the gas valve 12 is mounted below it. Relays A and B are shown at the bottom of the housing 42**.

The gas valve 12 includes an inlet **12*d*, for gas, which in known manner, would be connected to a gas supply, and has an outlet connected to a flow-controlling orifice 25. This in turn discharges into a burner tube 26, with the orifice 25 and the burner 26** being configured in known manner.

At the outlet of the burner tube 26, there is mounted the igniter 11 and also the temperature sensor 6, as shown. The arrow 46 indicates the flow of combustion gases from the burner tube 26.

The combustion zone 45 is defined within the first part of a lower tubular heat exchanger section 16. The combustion chamber 45 is lined with flexible insulation 17, to reduce the wall temperature, and hence, ensure more uniform heat transfer from the tubular heat exchanger section 16.

As shown in FIG. 3, at the left hand end of the heat exchanger 16, there is an elbow 18 connecting the lower section to an upper finned tubular heat exchanger section 19. A tubulator 24 is located within the finned tubular heat exchanger 19, both to create turbulence and to increase internal flow velocity, thereby to promote heat transfer from the hot combustion gases to the body of the upper section 19.

At its end, the heat exchanger section 19 turns through 90° and is connected to an exhaust tube 20. The tube 20 is coaxial within the combustion air in the inlet pipe 15, the combustion gases flowing counterflow to the incoming air. This effects further heat transfer and promotes overall thermal efficiency. Residual heat in the combustion gases is transferred to the incoming combustion air.

In use, with the baseboard heater connected to line voltage, connected to a domestic gas supply and in standby mode (heat not called for), the thermostat 5 is in the open position, the probe-type temperature sensor 6 is in the closed position and the coil 7 of relay A is energized. With the above relay coil 7 energized, the two contacts 8, 8', for the relay are in the swing left position, i.e. as shown in FIG. 3 with contact **8*a* closed and contacts 8' closed. At this point some current will flow through the holding coil 12*a*, but this will be insufficient to open the valve 12**.

On a call for heat, the following sequence would occur: the room thermostat switch 5 closes thereby energizing the combustion air blower 9. When the blower 9 is at its operating speed, the differential pressure switch 10 senses that the difference in pressure between the intake and discharge sides of the blower 9 is at or above a preset value, indicating an adequate supply of combustion air, and it closes. When the pressure switch 10 closes, the igniter 11 is energized and begins to heat up. The temperature sensor 6, due to its placement in close proximity to the igniter 11, also heats up. When the temperature sensor 6 heats up to its critical temperature, it opens and de-energizes the coil 7 of relay A which causes the contacts of relay A to swing to the right, i.e. contact 8 closes at 8*b* and contacts 8' open, and de-energize the igniter 11. The gas valve 12 is thus energized, and current flows through the secondary and booster coils 12b, c. This opens starts to flow, which gas is ignited by the igniter 11 while it is still hot. Simultaneously, since the contact 8*b* of relay A is closed, the coil 13 of relay B is energized and the contacts 14 of relay B closes. The temperature switch 6 is kept open by maintaining it above its critical temperature by sensing heat generated from the flame.

The baseboard heater operates until the thermostat 5 is satisfied that the required temperature has been reached, at which point it opens and de-energizes the blower 9 and the gas valve 12. The temperature switch 6 cools down and closes. The system is once again in the standby mode, shown in FIG. 2.

If, during normal operation, there is a loss of flame, for example, due to a loss of gas pressure, the lockout timing mechanism 21 would operate to stop the flow of gas to the heater within a preset time, here 60 seconds. Upon a loss of flame, the thermostat 5 remains closed since it is not yet satisfied. The pressure switch 10 also remains closed since the blower 9 continues to operate, which in turn ensures that contacts 14 of relay B remains closed and the coil 13 of relay B is still energized. When the temperature sensor 6 cools down, due to the loss of heat from the flame, to its preset temperature, it closes. This energizes the coil 7 of relay A; its contacts 8 swing to the left and close 8*a* and contacts 8' close. Since the contacts 14 of relay B are closed, the coil 13 for relay B remains energized. The igniter 11 and the time delay heater 22 are then energized. The igniter 11 heats up, thereby heating the temperature switch 6 and at its preset temperature, the switch 6 opens. Again, simultaneous coils 12*b* and *c* are energised and the gas valve 12 opens to permit the flow of gas. Coil 7 of relay A is de-energized and thus its contacts swing to the right.

If the gas pressure has been restored and there is a flow of gas to the heater, then ignition will take place as described earlier and the heater will continue to operate in its normal manner until the thermostat 5 has been satisfied. If ignition does not take place, the temperature switch 6 will again cool down and close and a second trial for ignition will take place.

Consider further the initial trial for ignition on the loss of flame. While the relay A is energized, the time delay heater 22 is also energized. During this time, the time delay heater 22 begins to heat up the thermally operated time delay switch 23. The time delay switch 23 is selected to reach its critical temperature after a preselected time, here 60 seconds. When this time is reached it opens to close gas valve 12*b* and hence it allows no more than 60 seconds of gas flow after loss of flame.

When further trials for ignition occur, as the temperature switch 6 opens and the coil 7 of relay A is de-energized, the contacts 8' of relay A are opened, to de-energize the time delay heater 22. The time delay switch 23 then slowly cools down. However, the time delay switch 23 does not cool down to its original temperature before the ignition sequence repeats itself and the time delay switch 23 begins to heat up again. In this manner, after a few trials for ignition, the time delay switch 23 reaches its preset temperature and opens, thereby preventing the igniter 11 from being energized any further. The time delay switch 23 must then be manually (from the thermostat 5) reset before another trial for ignition can take place.

The heater is designed to operate at a firing rate of approximately 1.5 kW (5,000 BTU/h). The firing rate is controlled by the combination regulator and control gas valve 12 and the flow controlling orifice 25.

While an embodiment of the power-vented version of this heater having a firing rate of 1.5 kW (5,000 BTU/h) has been described, the heater may be operated at alternate firing rates. The heat exchanger components (comprising of 16, 18 and 19) may be of selected sizes to permit higher inputs by using a firing rate of about 0.37 kW (1,250 BTU/h) per linear foot.

Figure 6:
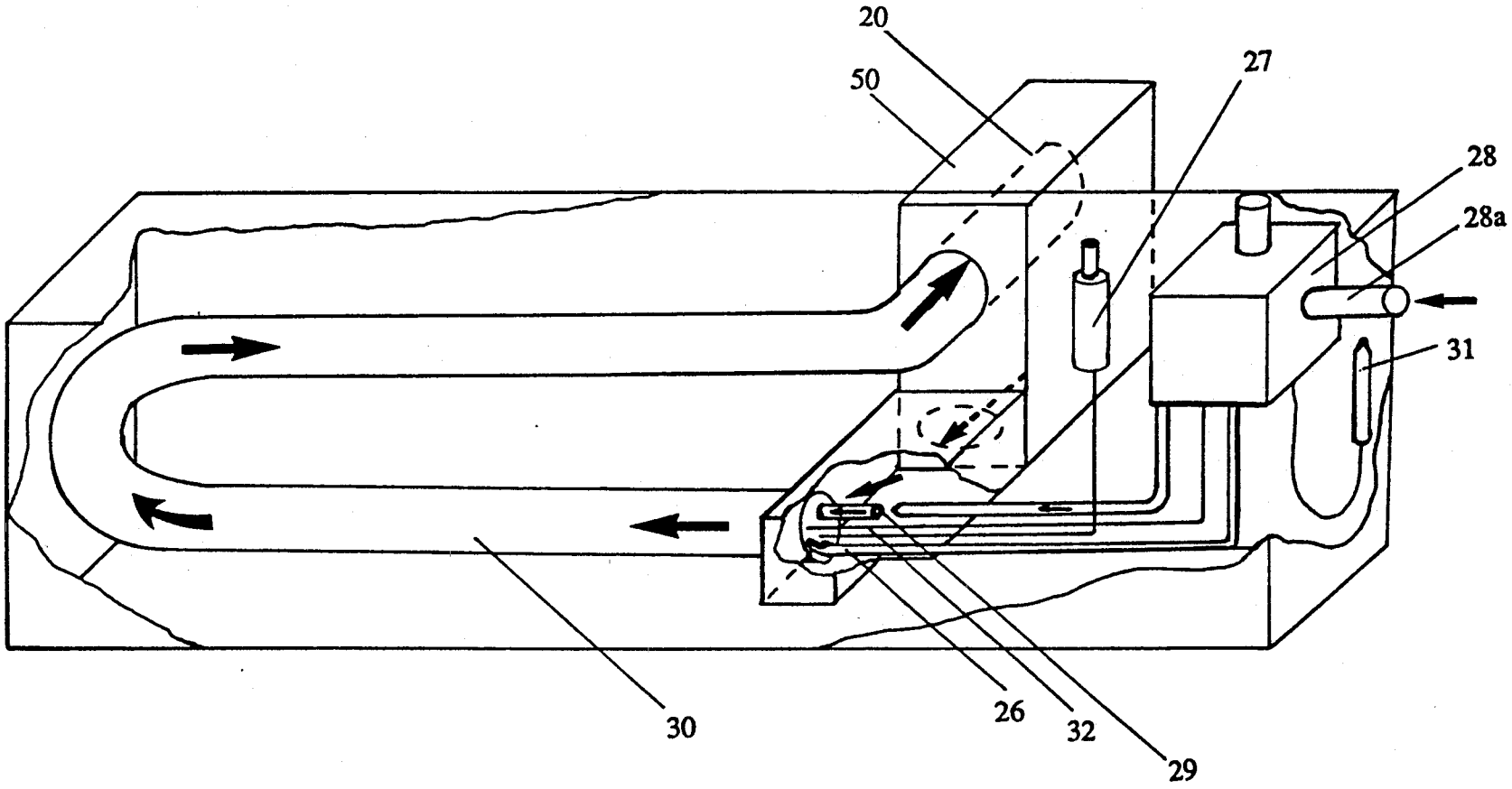
FIG. 6 is a perspective view of a typical naturally-vented embodiment of the baseboard heater in its casing.

The natural draft version of this invention operates in much the same way as the power-vented version, and is shown in FIG. 6. Here, a standing pilot 26 is lit using a piezo-electric igniter 27, in known manner. When there is a call for heat, the gas valve 28 opens to permit gas to flow from its inlet 28*a* to the single port burner 29. Combustion air and gas mix and are ignited at the mouth of the heat exchanger 30 by the standing pilot 26. The single port burner 29 provides the necessary momentum to move the combustion products through the U-shaped heat exchanger 30 and vent them to the outdoors. When the local thermostat 31 is satisfied, it deactivates the gas valve 28 and the flow of gas is stopped. If during normal operation, there is a flame outage, such as due to a loss of gas pressure, the outage would be sensed by a thermocouple 32 and the gas valve 28 would be de-energized. Upon restoration of gas pressure, the pilot 26 would have to be manually relit using the piezo-electric spark igniter 27. The configuration of the heat exchanger could be generally similar to that in the first embodiment with a similar exhaust outlet or tube. However, as it relies on natural draft, the interior of the duct would have generally larger dimensions, and the turbulator 24 would be omitted. As shown at 50, a rectangular intake duct provides ample space for incoming air while reducing flow resistance. This surrounds the exhaust or outlet duct 20.

It will be appreciated that while two preferred embodiments have been described, numerous variations are possible. For example, the heat exchanger could have a clamshell-type of construction. Such construction includes two sheets configured to be joined together along their edges. The sheets are then shaped to give a desired internal configuration. Here, the sheets would be configured to give the upper and lower heat exchanger sections, and would be generally symmetrical about a central plane.

We claim:

1. A gas-fired heater, for mounting on a wall within a building, the heater comprising:

a gas inlet for combustion gas;

a combustion air inlet;

a burner connected to the combustion air and gas inlets; and an elongate U-shaped heat exchanger including a generally horizontal lower section having an inlet into which the burner discharges combustion gases, and a generally horizontal upper section connected to the lower section and having an outlet for combustion gases, wherein the lower section includes an inlet portion adjacent the inlet thereof, which inlet portion is lined with insulating material, to reduce heat transfer therefrom and thereby promote more uniform heat dissipation along the length of the heat exchanger.

2. A heater as claimed in claim 1, which includes a generally elongate housing within which the heat exchanger and burner are located, which housing is adapted for mounting to a wall and includes elongate upper and lower openings to permit natural convection of ambient air over the heat exchanger.

3. A heat exchanger as claimed in claim 2, wherein the burner is directed horizontally into the inlet of the lower section of the heat exchanger.

4. A heater as claimed in claim 3, wherein the burner comprises a mono-port burner.

5. A heater as claimed in claim 3, wherein the upper and lower sections of the heat exchanger are generally tubular and are connected by an elbow.

6. A heater as claimed in claim 5, wherein the bottom section of the heat exchanger is of larger internal cross-section than the top section.

7. A heater as claimed in claim 6, wherein the top section of the heat exchanger is finned to provide increased heat transfer to ambient air.

8. A heater as claimed in claim 7, wherein the top section of the heat exchanger includes a turbulator to promote heat transfer from the combustion gases.

9. A heater as claimed in claim 5, wherein the heat exchanger has a clamshell construction and is formed from two metal sheets which are substantially symmetrical about a central plane.

10. A heater as claimed in claim 5, which includes a blower for providing forced convection through the heat exchanger.

11. A heater as claimed in claim 10, wherein the upper section of the heat exchanger is finned, and includes a turbulator therein to promote heat transfer through the upper section of the heat exchanger.

12. A heater as claimed in claim 19, which includes a pair of electric power supply lines for supplying power to the blower, a thermostat in one power supply line for controlling power supply to the blower, a gas valve and an igniter connected between the control lines, and a differential pressure switch mounted in a power line, for only permitting power supply to the gas valve and the igniter if adequate air flow is present.

13. A heater as claimed in claim 12, which includes a control relay connected in series with a temperature sensor between the power supply lines, the temperature sensor being mounted adjacent the igniter, and the relay including contacts connected in series with the igniter for supplying power thereto and for controlling power supply to the gas valve, until a pre-determined temperature is reached as detected by the temperature sensor, whereupon the power supply to the igniter is interrupted and the gas valve is activated to permit supply of gas to the burner.

14. A heater as claimed in claim 13, which includes a time-delay switch connected in series with the igniter, a time-delay heater, and a further control relay including contacts in series with the time-delay heater, the further control relay being activated with the igniter to close these contacts to supply power to the time delay heater, the time-delay switch opening after a preset period, to disable the igniter if ignition has not occurred within that preset period.

15. A heater as claimed in claim 1, which includes a pilot, a gas valve connected between the gas inlet and both the pilot and the burner for controlling combustion air supply, and a thermostat for controlling actuation of the gas valve to control gas supplied to the burner.

16. A heater as claimed in claim 15, wherein the pilot comprises a standing pilot, which includes a thermocouple mounted for sensing heat generated by the standing pilot, and for actuating the gas valve to close off gas supply to the pilot and the burner if the pilot fails.

17. A heater as claimed in claim 15, which includes an intermittent pilot and a thermocouple mounted adjacent the pilot for sensing heat generated by the pilot, and for controlling the gas valve to control gas supplied to the pilot and the burner.

18. A heater as claimed in claim 16 or 17, which includes a piezo-electric ignition device for igniting the pilot.

19. A heater as claimed in claim 5, 6 or 7, wherein the thermostat is mounted remotely and separately from the heater.

20. A gas-fired heater, for mounting on a wall within a building, the heater comprising:

a gas inlet for combustion gas;

a combustion air inlet;

a burner connected to the combustion air and gas inlets;

an elongate U-shaped heat exchanger including a generally horizontal lower section having inlet into which the burner discharges combustion gases, and a generally horizontal upper section connected to the lower section and having an outlet for combustion gases;

a blower for providing forced convection through the heat exchanger; and a control circuit including a pair of electric power supply lines, supplying power to the blower, a thermostat in one power supply line for controlling power supplied to the blower, a gas valve connected between the gas inlet and the burner and connected between the control lines, an igniter connected between the control lines, and a differential pressure switch mounted in a power line, for only permitting power supply to the gas valve and igniter if adequate air flow is present through the heater.

21. A heater as claimed in claim 20, which includes a control relay connected in series with a temperature sensor between the power supply lines, the temperature sensor being mounted adjacent the igniter, and the relay including contacts connected in series with the igniter to supply power thereto and for controlling power supply to the gas valve, until a pre-determined temperature is reached as detected by the temperature sensor, whereupon the power supply to the igniter is interrupted and the gas valve is activated to permit supply of gas to the gas burner.

22. A heater as claimed in claim 21, which includes a time-delay switch connected in series with the igniter, a time-delay heater and a further control relay including contacts in series with the time-delay heater, the further control relay being activated by the igniter to close these contacts to supply power to the time-delay heater, the time-delay switch opening after a preset period, to disable the igniter if ignition has not occurred within that preset period.

* * * * *